United States Patent [19]

Callihan et al.

[11] 4,450,912

[45] May 29, 1984

[54] METHOD AND APPARATUS FOR WELL CEMENTING THROUGH A TUBULAR MEMBER

[75] Inventors: Rudy B. Callihan; Lyndon R. Stone, both of San Antonio, Tex.

[73] Assignee: Baker Oil Tools, Inc., Orange, Calif.

[21] Appl. No.: 385,616

[22] Filed: Jun. 7, 1982

[51] Int. Cl.[3] ..... E21B 33/14

[52] U.S. Cl. ..... 166/289; 166/318; 166/317; 166/290

[58] Field of Search ..... 166/289, 290, 185, 317, 166/318, 237

[56] References Cited

U.S. PATENT DOCUMENTS

| | | | |
|---|---|---|---|
| 2,435,016 | 1/1948 | Pitts | 166/289 X |
| 3,223,160 | 12/1965 | Baker | 166/289 |
| 4,260,017 | 4/1981 | Nelson et al. | 166/289 X |

*Primary Examiner*—Ernest R. Purser
*Assistant Examiner*—Michael Starinsky
*Attorney, Agent, or Firm*—Norvell & Associates

[57] ABSTRACT

This invention provides a method and apparatus for effecting two stage cementing of well conduits by supplying cement through a tubular member. The apparatus involved provides a tubular conduit extension attachable to the bottom end of a well conduit and defines a cementing passage through its bottom end. Cementing ports are provided in the extension at a distance above its bottom end. A pair of concentrically adjacent valve units are communicable with the extension with the inner valve unit positioned in a closed position relative to the cement ports. The inner valve unit defines a seal bore which receives a mandrel which is secured to the tubular member. The mandrel incorporates two pilot sleeve valves which are positioned in closing relationship to radial passages in the hollow mandrel and each of which defines an upwardly facing surface for reception of sealing balls or plugs. The first stage of the cementing is accomplished by flow of cement from the tubular member through the mandrel and the extension and out the bottom end thereof. A sealing ball or plug is then dropped through the tubular member into engagement with the lower pilot sleeve valve. Increased pressure urges the lower pilot sleeve valve to open the radial cementing passages in the mandrel and then shifts the inner valve unit to open the cementing ports in the tubular extension. The second stage of cementing can then be accomplished by cement introduced through the tubular member and passing outwardly through the mandrel passages and the radial cement ports. A plug is pumped down the tubular member into engagement with the upper pilot sleeve valve. Increased fluid pressure shifts the upper pilot sleeve valve to expose a passage in the mandrel and provide flow to a chamber surrounding a surface on the second outer valve unit. Increased fluid pressure in the bore of the tubular member will then produce a shifting of the second outer valve unit to seal the cement ports.

11 Claims, 4 Drawing Figures

METHOD AND APPARATUS FOR WELL CEMENTING THROUGH A TUBULAR MEMBER

BACKGROUND OF THE INVENTION

1. Field of the Invention:

The invention relates to the cementing of subterranean well conduits by cement supplied through a substantially smaller diameter drill pipe or work string extended downwardly through the conduit.

2. Description of the Prior Art:

The practice of cementing well casings in wells is standard in the industry. When wells were drilled to accommodate moderate size casing diameters, it was expedient to supply the cement for the cementing operation by pumping the cementing fluid directly through the bore of the casing. As casing sizes and well depths have increased, it has become increasingly difficult to utilize the entire casing bore as a conduit for the cement due to the large quantities of cement that are required to be transmitted through the casing bore and to the comparatively large pressures required to force that large fluid volume of cement outwardly and upwardly around the exterior of the casing. Furthermore, the casing has to be carefully wiped subsequent to the cementing operation, thus frequently resulting in patches of cement film being adhered to a large number of regions of the casing which would substantially interfere with the deployment and setting of tools normally required to place a well in production.

In recent years, it has been the practice to accomplish the cementing of large diameter well casing by running in a small diameter drill pipe to the bottom of the casing and supplying the cementing fluid through the drill pipe. Furthermore, after the cementing operation, the drill pipe can be removed.

Even with drill pipe application of cement, there is a practical limit to the amount of cement that can be caused to flow upwardly around the exterior of the well casing. It therefore becomes desirable to effect the cementing of the well through the drill pipe in at least two stages. In the first stage, the cement is discharged into the well bore through an axial cement conduit formed in the bottom of the casing. In the second stage, cement is discharged through radial ports provided in the well casing at a position above the level of the cement introduced during the first stage. The radial cementing ports have to be sealed during the first stage cementing operation and then resealed at the conclusion of the second stage cementing operation.

SUMMARY OF THE INVENTION

The invention provides a method and apparatus for effecting two stage cementing of well casing or conduit by cement fluid introduced through a small diameter drill pipe or tubular member. A tubular assembly, constituting in effect an extension of the well casing, is secured to the bottom end of the casing and inserted in the well bore with the casing. The tubular casing extension includes an axial cementing conduit in its bottom end which may be provided with a customary float shoe.

The tubular casing extension is further provided with a plurality of peripherally spaced radial cementing ports located at a sufficient height above the bottom end of the tubular casing extension to insure that the first stage cementing will not rise to the level of the radial cementing ports. A pair of axially spaced annular valving units are communicable with the tubular casing extension to successively cooperate with the radial cement ports. The first or inner valving unit is selectively releasably retained in a position closing the radial cement ports. The second or outer valving unit is preferably disposed on the exterior of the tubular casing extension and is selectively releasably positioned above the radial cement ports but can, after activation, be moved into sealing relationship with respect to the radial cement ports.

The inner annular valving unit defines an axially elongated seal bore which sealingly receives the exterior of a hollow mandrel which has its upper end connected to the bottom end of the drill pipe. The hollow mandrel has a first set of radial passages that are alignable with the radial cement ports but are initially sealed by a first lower pilot sleeve valve selectively releasably positioned in the bore of the hollow mandrel. The first lower pilot sleeve valve incorporates an annular sealing surface upon which a sealing ball may be dropped through the drill pipe to effectively close the bore of the drill pipe to fluid passage. Increasing the fluid pressure in the drill pipe bore will then produce a force on the pilot sleeve moving it to an open position relative to the radial cementing ports provided in the mandrel. Such fluid pressure is then applied to a surface of the inner annular valve unit to shift such unit to an opening position with respect to the radial cementing ports in the tubular casing extension. Thus a second stage cementing operation can be performed by supplying cement through the drill pipe and flowing it radially outwardly through the aligned radial cementing passages in the hollow mandrel and in the tubular casing extension.

A second upper pilot sleeve valve mounted in the bore of the hollow mandrel initially closes a second set of radial passages in the mandrel which are communicable with radial passages in the tubular casing extension to provide power fluid to an annular chamber surrounding the upper end of the second outer annular valve unit. The upper pilot sleeve valve defines a sealing surface upon which a wiping plug, passed through the drill pipe, is sealingly engaged to effectively close the bore of the drill pipe, permitting the fluid pressure to be increased in the drill pipe. Such increased fluid pressure shifts the second upper pilot sleeve valve into abutting engagement with the first pilot sleeve valve and opens the second set of radial fluid passages in the hollow mandrel, thus permitting fluid flow into the annular chamber surrounding the top end of the second annular valve unit. The second outer annular valve unit is moved into sealing relationship with the radial cementing ports in the tubular casing extension and is latched in such sealed position. The sealing of the radial cementing ports in the tubular casing extension by a sleeve member disposed on the exterior of such extension permits all internal components of the cementing stage apparatus to be drilled out to provide an unrestricted bore, without in any manner disturbing the external seal of the radial cementing ports.

DESCRIPTION OF THE PREFERRED EMBODIMENTS

Figure 1A:
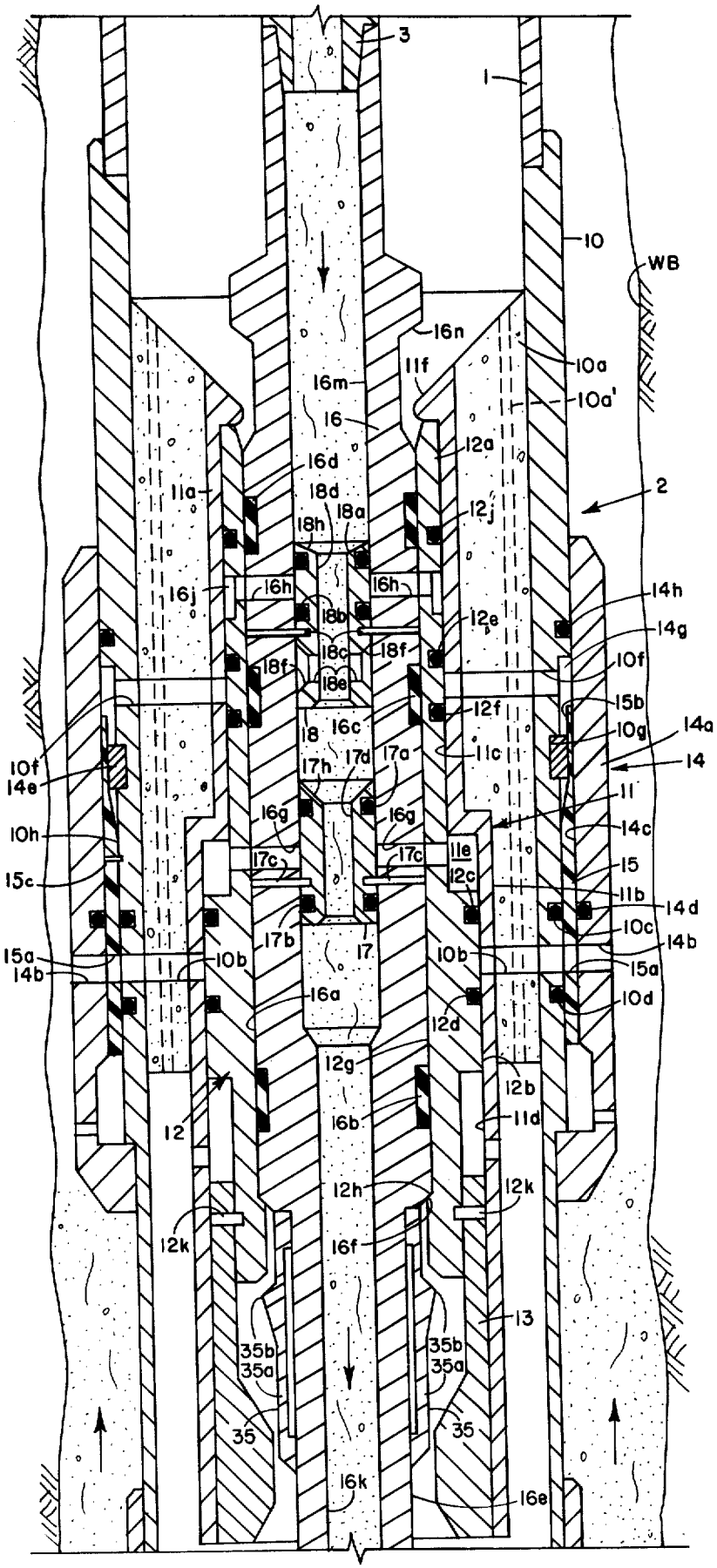
FIGS. 1A and 1B collectively represent a vertical sectional view of a two stage cementing apparatus embodying this invention, with the elements thereof shown in their initial positions when first installed in a well bore, FIG. 1B being a vertical continuation of FIG. 1A.
Figure 1B:
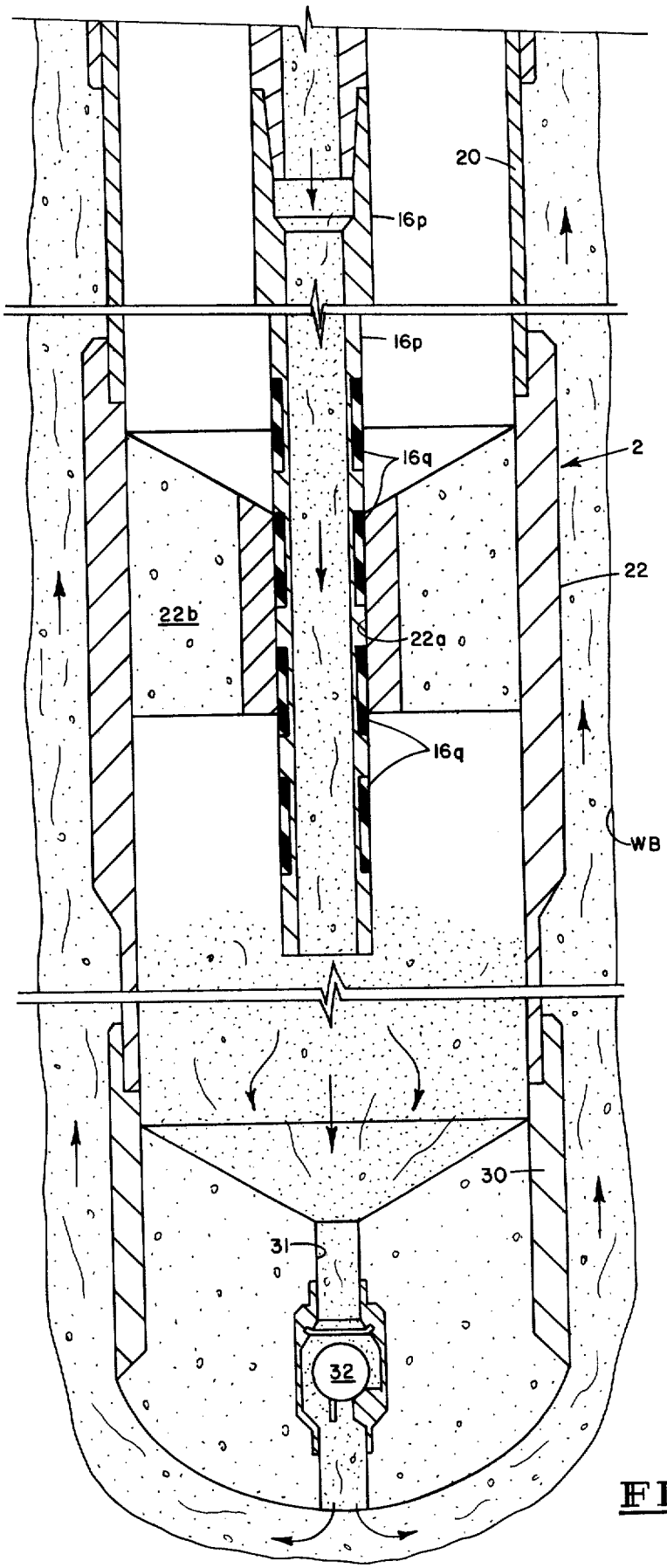

Referring to FIGS. 1A and 1B, a casing 1 is shown inserted in a newly drilled well bore WB. On the lower end of casing 1, a tubular extension 2 incorporating a cementing apparatus embodying this invention is suitably secured by threads or welding. The tubular extension 2 in effect constitutes a continuation of the well casing 1 to a desired point above the bottom of the well bore WB. Tubular extension 2 comprises a threaded assembly of a plurality of threadably connected sleeve elements 10, 20, 22 and 30 in descending order. The sleeve element 10 constitutes a housing for a plurality of valve elements, sleeve element 20 is a spacing sleeve, sleeve element 22 constitutes a seal bore support, and the lowermost sleeve element 30 is a conventional cement float shoe.

The top sleeve element 10 is conventionally connected to the bottom end of the casing 1. A seal bore sleeve 11 is suitably secured, as by an annular cement layer 10*a*, to the interior of the top valve housing sleeve 10. Seal bore sleeve 11 comprises an upper reduced diameter portion 11*a* and a lower, larger diameter portion 11*b* having polished interior bore surfaces 11*c* and 11*d* respectively. The top sleeve element 10 is further provided with a plurality of peripherally spaced radial cement ports 10*b* which extend through the walls of the large diameter seal bore sleeve portion 11*b* and the annular cement layer 10*a*.

A first annular valve unit 12 is slidably mounted for axial movements within the seal bores 11*c* and 11*d*. Annular valve unit 12 is provided with an enlarged diameter portion 12*b* which slidably cooperates with the enlarged seal bore 11*d*, and a small diameter portion 12*a* which slidably cooperates with the smaller seal bore 11*c*. A pair of annular seals 12*c* and 12*d* are respectively provided on the periphery of the enlarged diameter valve portion 12*b* and, in their initial position, are respectively disposed above and below the radial cementing ports 10*b*, thus effectively sealing the radial cementing ports. Annular valve unit 12 is secured in its initial position by a plurality of peripherally spaced shear pins 12*k* which extend between the lower portion of the first annular valve unit 12 and an abutment sleeve 13 which is suitably rigidly secured to the bottom inner end of the seal bore sleeve 11. Additional vertically spaced annular seals 12*e*, 12*f* and 12*j* are provided on the small diameter portion 12*a* of the first annular valve unit 12 and sealingly engage the small diameter seal bore 11*c* for purposes that will be hereinafter described.

A second annular valve unit 14 is provided in peripherally surrounding relationship to the top sleeve 10. The second annular valve unit 14 comprises a sleeve housing 14*a* which is welded or otherwise rigidly secured to the exterior of the top sleeve 10. Sleeve 14*a* cooperates with a reduced diameter exterior section 10*h* on the top sleeve 10 to define an annular pressure chamber 14*g*. A plurality of peripherally spaced radial cement passages 14*b* are provided in the housing sleeve 14*a* and are alignable with the radial cementing ports 10*b* provided on the top sleeve 10.

A sleeve type valve 15, is mounted in the annular pressure chamber 14*g*. By downward axial shifting movement of the valve sleeve 15, ports 15*a* are sealed against fluid leakage by annular seals 10*c* and 10*d* disposed above and below ports 15*a*. When fluid pressure is applied to the annular pressure chamber 14*g*, upward flow of such fluid pressure is prevented by an annular seal 14*h* disposed between the adjacent surfaces of the housing sleeve 14*a* and the outer periphery of top sleeve 10. Radially aligned annular seals 10*c* and 14*d* respectively disposed between the sleeve valve 15 and the outer surface 10*h* of top sleeve 10 and the inner surface 14*c* of the valve housing sleeve 14*a* prevent fluid flow in a downward direction. A plurality of peripherially spaced radial passages 10*f* for power fluid are provided through the walls of top sleeve 10, the annular cement supporting layer 10*a* and the seal bore sleeve 11 to provide power fluid to the top end of the annular fluid chamber 14*g*, in a manner to be later described.

Valve sleeve 15 is secured in its initial position by a plurality of peripherally spaced shear pins 15*c* which extend between the valve sleeve 15 and the exterior of top sleeve 10.

A plurality of peripherally spaced, radial power fluid passages 10*f* are provided in the top sleeve 10, the cement bonding layer 10*a* and the seal bore sleeve 11, and, in the initial position of the first annular valve unit 12, the annular seals 12*e* and 12*f* are respectively disposed above and below the radial power fluid passages 10*f*. The radial power fluid passages 10*f* communicate with the annular chamber 14*g* formed immediately above the valve sleeve 15 of the second valve unit 14. In the initial positions of the first or inner valve unit 12 and the second or outer valve unit 14, as shown in FIG. 1, the power fluid passages 10*f* provided in the top sleeve element 10 are effectively sealed against entry of any fluids.

The inner annular valve unit 12 further defines an axially extending seal bore 12*g* which terminates at its lower end with an inwardly projecting no-go shoulder 12*h*. A hollow mandrel 16, which is suitably connected to the end of a small diameter drill pipe 3 extending downwardly through the casing 1, is provided with a cylindrical exterior surface 16*a* on which are mounted a plurality of axially spaced annular seals 16*b*, 16*c* and 16*d*, which sealingly cooperate with the seal bore 12*g* of the first annular valve unit 12. Hollow mandrel 16 is further provided with a reduced diameter bottom end portion 16*e*, thus defining a downwardly facing abutment shoulder 16*f* which, in the initial position of the apparatus, is in abutting engagement with the no-go shoulder 12*h* provided on the first annular valve unit 12.

To assist in the initial positioning of the hollow mandrel 16 relative to the seal bore 12*g*, an annular positioning collet 35 is suitably mounted on the exterior of hollow mandrel 16 at a position just below the shoulder 16*f*. Collet 35 is provided with inwardly flexible collet arms 35*a* having outwardly disposed shoulders 35*b* which are engagable with the upwardly facing no-go shoulder 12*h* to provide the operator with an indication that the hollow mandrel 16 is in its approximate position. Thereafter, through the application of weight to the hollow mandrel 16, the collet arms 35*a* can be depressed inwardly and the hollow mandrel 16 seated in its position illustrated in FIG. 1 with the shoulder 16*f* of the hollow mandrel in abutting engagement with the no-go shoulder 12*h* on the first annular valve unit 12.

The reduced diameter portion 16e of hollow mandrel 16 is threadably secured at its bottom end to a tubular extension 16p having axially spaced, external seals 16q secured to its bottom end and sealingly engaging a seal bore 22a supported by a cement layer 22b in the seal bore sleeve 22 of the casing extension 2.

Intermediate the annular seals 16b and 16c on hollow mandrel 16, there is provided a plurality of peripherally spaced radial cement passages 16g which, in the initial position of the apparatus shown in FIG. 1, communicate only with an annular chamber 11e defined between the interior of the large diameter portion 11b of seal bore sleeve 11 and the small diameter portion 12a of the first annular valve unit 12. Additionally, hollow mandrel 16 is provided with a plurality of peripherally spaced, radial power fluid passages 16h which are disposed between annular seals 16c and 16d and, in the initial position of the apparatus, such passages communicate only with an annular recess 16j provided in the cylindrical surface 16a of the hollow mandrel 16.

The axial bore 16k of hollow mandrel 16 has its upper portion enlarged as indicated at 16m. The lower bore portion 16k communicates through extension 16p with the open bore of the seal bore sleeve 22 and hence with the axial bore 31 defined by the cement float shoe sleeve 30.

When the hollow mandrel 16 is suitably affixed to the end of the small diameter drill pipe 3, and stabbed into the seal bore 12g of the first annular valve unit 12 and the seal bore 22a of sleeve 22, cementing fluid can be supplied through the drill pipe and hollow mandrel through the cement float shoe valve 32 and outwardly and upwardly around the casing extension 2. Thus the first stage of the cementing operation proceeds in conventional fashion with an axial flow and discharge of the cementing fluid. The height of the spacer sleeve 20 and seal bore sleeve 22 is selected so as to position the radial cementing ports 10b in the top sleeve 10 at a position safely above the anticipated height achieved by the cement supplied during the first cementing stage.

To effect the shifting of the inner annular valve unit 12 to permit the second cementing stage to be applied through the radial cement ports 10b, a first pilot sleeve valve 17 is inserted in the enlarged bore portion 16m of the mandrel 16. Pilot sleeve valve 17 incorporates a pair of vertically spaced, annular seals 17a and 17b which sealingly engage the interior surface of the enlarged mandrel bore 16m. The pilot sleeve valve 17 is secured in an initial position by a plurality of radial shear pins 17c with the annular seals 17a and 17b respectively disposed above and below the radial cement passages 16g provided in hollow mandrel 16. Thus cement supplied during the first stage operation cannot enter the radial cementing passages 16g, but the bore 17d of the first pilot valve sleeve 17 is sufficiently large to permit the ready passage of cementing fluid axially therethrough.

To prevent the cementing fluid from passing into the radial power fluid passages 16h provided in the hollow mandrel 16, a second pilot sleeve valve 18 is provided which is substantially similar to the first pilot sleeve valve 17. Thus pilot sleeve valve 18 is provided with a pair of vertically spaced, annular seals 18a and 18b which cooperate with mandrel bore 16m, and, in the initial position of the second pilot sleeve valve 18, are respectively disposed above and below the power fluid radial passages 16h provided in the hollow mandrel 16. The second pilot sleeve valve 18 is secured in its initial position by a plurality of peripherally spaced, radially disposed shear pins 18c. Lastly, the second pilot sleeve valve 18 is provided with a plurality of peripherally spaced radial passages 18e respectively communicating with an annular recess 18f formed in the periphery of the lower end of the second pilot sleeve valve 18. Alternatively, the valve 18 may be provided without passages 18e and its lower travel restricted by providing travel resisting abutments in the internal diameter of the base 16m.

Within the cement 10a are provided a plurality of circumferentially spaced longitudinal extending passageways 10a' the upper end of each communicating with the interior of the casing 1 above the element 10, and the lower end communicating with the interior area within the casing 1 below the cement 10a. The passageways 10a' maintain continuous pressure equalization integrity across the cement 10a and permits installation and removal of the mandrel element 16 to and from sealed position within the valve unit 12 without hydrostatic pressure locking.

The first pilot sleeve valve 17 and the second pilot sleeve valve 18 are respectively provided with upwardly facing, inclined, annular sealing surfaces 17h and 18h to respectively receive sealing plugs or balls dropped successively through the drill pipe 3. Of course, the annular sealing surface 17h formed on the lower pilot sleeve valve 17 is of smaller internal diameter than the annular sealing surface 18h formed on the upper pilot sleeve valve 18 in order to permit the ball or plug which seals the bore 17d of lower pilot sleeve valve 17 to readily pass through the bore 18d of the upper pilot sleeve valve 18.

OPERATION

Figure 2:
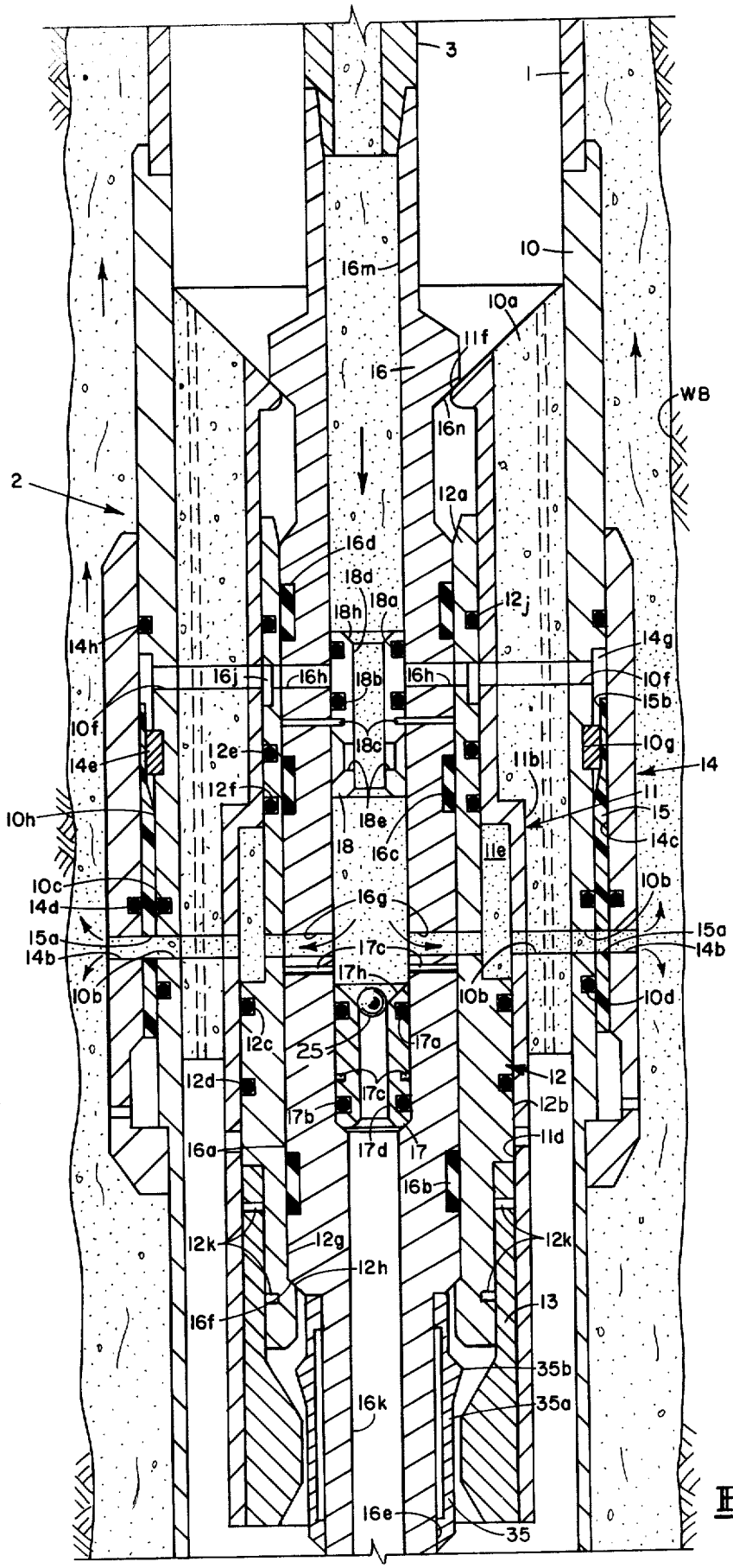
FIG. 2 is a view similar to FIG. 1A but showing the elements of the apparatus during the conduct of the second stage of cementing operations.

After completion of the first cementing stage by axial flow of cement through the drill pipe 3, in the manner heretofore described, a sealing ball or plug 25 (FIG. 2) is then dropped through the drill pipe 3 to rest upon and seal the annular sealing surface 17h provided on the top of the first pilot sleeve valve 17. The drill pipe 3 is then filled with an appropriate power fluid, such as drilling mud. Since ball 25 effectively seals the bore of the drill pipe 3, the pressure of the power fluid contained in the drill pipe may be increased. Such increase in pressure first effects the shearing of the shear pins 17c which hold the first pilot sleeve valve 17 in its initial position relative to the hollow mandrel 16. Pilot sleeve valve 17 then moves downwardly in the enlarged mandrel bore 16m and exposes the radial cementing passages 16g in the hollow mandrel 16 to fluid flow from the bore 16m, as shown in FIG. 2. The fluid flows through the radial cement passages 16g into the annular chamber 11e and there acts upon the enlarged diameter portion 12b of the first annular valve unit 12 moves the annular seal 12c downwardly past the radial cement ports 10b and thus establishes a fluid passage from the bore of the drill pipe 3 to the outer periphery of the casing extension 2. Such downward movement of the first annular valve unit 12 also produces a downward movement of the no-go shoulder 12h, permitting the hollow mandrel 16 to be lowered by the drill pipe 3 until a projecting shoulder 16n on the upper end of the hollow mandrel 16 engages an inwardly projecting shoulder 11f provided on the top end of the seal bore sleeve 11, as shown in FIG. 2.

The cementing operation can then proceed in the manner illustrated in FIG. 2 of the drawings. The cement is forced downwardly through the drill pipe 3, the bore 16*m* of hollow mandrel 16, thence radially outwardly through the mandrel radial cement passages 16*g* and thence through the radial cement ports 10*b* provided in the top sleeve 10.

When sufficient cement has been thus introduced into the region exterior of the casing extension 2, a combination sealing and wiping plug 26 (FIG. 3) is then moved through the bore of the drill pipe 3 and into the enlarged bore 16*m* of hollow mandrel 16, achieving a sealing engagement with the upwardly facing sealing surface 18*h* provided on the top of the second pilot sleeve valve 18. Plug 26 is preferably provided with a plurality of radially projecting, elastomeric wiping flanges 26*a* which achieve a wiping of cement from the bore of the drill pipe 3 and the enlarged bore 16*m* of the hollow mandrel 16.

Figure 3:
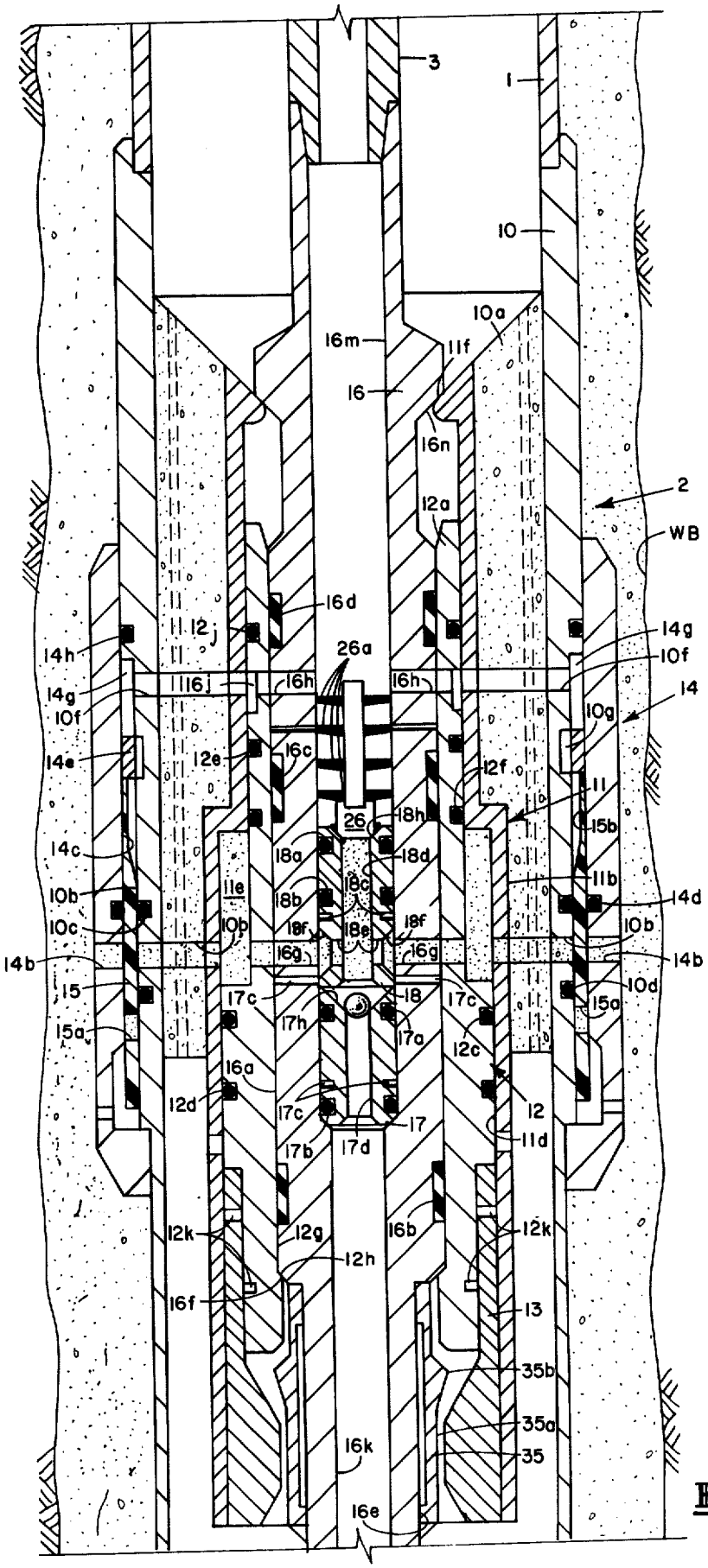
FIG. 3 is a view similar to FIG. 1A but illustrating the position of the components of the apparatus at the conclusion of the cementing operation.

Upon the seating of the combination wiping and sealing plug 26 on the annular sealing surface 18*h* on the second pilot sleeve valve 18, the fluid pressure within the drill pipe bore may be increased. Such increase in pressure first effects the shearing of the shear pins 18*c* which have secured the second pilot sleeve valve 18 in its initial position, thus permitting the pilot sleeve valve 18 to move downwardly until it abuts the first pilot sleeve valve 17. This downward movement opens the power fluid passages 16*h* provided in hollow mandrel 16 and the downward movement of the hollow mandrel 16 previously produced by downward movement of the drill pipe 3 effects the alignment of the annular recess 16*j* on the periphery of the hollow mandrel 16 with the power fluid radial passages 10*f* provided through the top sleeve 10, hence supplies power fluid to the annular chamber 14*g* overlying the upper end of the valve sleeve 15 of the second or outer annular valve unit 14. Such fluid pressure acts on the upwardly facing surfaces of valve sleeve 15 and effects a downward movement of the valve sleeve 15, thus moving the valve sleeve 15 past the radial cementing ports 10*b* formed in the top sleeve 10. Thus, the radial cementing passage is effectively sealed. To insure that the seal is maintained, the expandable C-ring 14*e* snaps outwardly to a position above the top end of the valve sleeve 15, preventing the return of the annular valve unit 14 to a port opening position (FIG. 3).

When the second pilot valve sleeve 18 moves into this position, the radial ports 18*e* and the annular recess 18*f* provided on the bottom end of pilot valve sleeve 18 are placed in communication with the radial cementing passages 16*g* and the annular chamber 11*e*, thus allowing the flow of any cementing fluid inwardly through the radial cement ports 10*b*, if valve sleeve 15 has not moved down to the closed position.

From the foregoing description, it will be readily apparent to those skilled in the art that the aforedescribed apparatus provides a simple, reliable method and apparatus for achieving the cementing of large diameter well casings in two stages, utilizing a small diameter drill pipe to supply the cement and the required power fluid. Moreover, when the second stage cementing operation is completed, the internal bore of the tubular casing extension 2 is sealed by sleeve element 15 disposed on the exterior of the casing extension 2 so that all of the cementing stage apparatus disposed within the bore of the casing extension 2 may be drilled out in order to provide a larger bore for the insertion of production equipment.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A two-stage cementing apparatus for a well conduit comprising: a tubular conduit extension connectable to the bottom of a well conduit; a tubular mandrel supported by a second conduit and insertable in said conduit extension; means in said tubular conduit extension for sealingly mounting the bottom end of said tubular mandrel; a plurality of peripherally spaced radial cement ports in said tubular conduit extension; a first annular valve unit mounted in said conduit extension for movement between a first sealing position relative to said radial cement ports and a second port opening position; first selectively releasable means for securing said first annular valve unit in said first sealing position; means including a first valve element insertable through the tubular mandrel for preventing fluid flow through said conduit extension, thereby permitting pressured fluid applied through the tubular mandrel to exert a force on said first annular valve unit to activate said first selectively releasable means and move said first annular valve unit to its said port opening position, said mandrel having radial cement passages alignable with said radial cement ports whereby cement may flow from the tubular mandrel through said radial cement ports; a second annular valve unit communicable with said tubular conduit extension for movement between a first nonsealing position relative to said radial cement ports and a second sealing position; means for securing said second valve unit in said first nonsealing position; and means including a second valve element insertable through the bore of the tubular mandrel for closing the axial passage of fluid through said tubular conduit extension, thereby permitting pressure fluid supplied through the tubular mandrel to exert a force on said second annular valve unit to move said second annular valve unit to its said port closing position.

2. The apparatus of claim 1 further comprising a pilot sleeve valve mounted in the bore of said mandrel;, second shearable means for positioning said pilot sleeve valve in closing relation to said mandrel radial passages, said pilot sleeve valve defining an annular sealing surface receiving said second valve element, whereby said pressurized fluid supplied through the tubular member is transmitted to pilot sleeve valve to activate said second selectively releasable means and move said pilot sleeve valve to an open position relative to said radial passages in said mandrel.

3. The apparatus of claim 2 wherein said mandrel has a second radial passage spaced above said radial cement passages; a second pilot sleeve valve initially mounted in the bore of said hollow mandrel above said first mentioned pilot sleeve valve and in closing relation to said mandrel second radial passage, said tubular conduit extension cooperating with said second annular valve unit to define an annular fluid chamber including an upwardly facing annular surface on said second annular valve; and fluid passage means interconnecting said annular fluid chamber and said mandrel second radial passage, said second pilot sleeve valve defining an upwardly facing, annular sealing surface to receive said second valve element, whereby said pressured fluid exerts a downward force on said second pilot sleeve valve to move said second pilot sleeve valve downwardly, opening said mandrel second radial passage and supplying pressured fluid to said annular chamber to shift said second annular valve downwardly to seal said radial cement ports.

4. The apparatus of claim 1 or 3 wherein said second valve element has radially projecting elastomeric wiping flanges arranged to wipe the bore of the tubular member.

5. The apparatus of claim 3 wherein said upwardly facing annular sealing surface on said second pilot sleeve valve is of greater bore diameter than said upwardly facing sealing surface on said first pilot sleeve valve.

6. The apparatus of claim 1 further comprising resilient means on said tubular conduit extension for locking said second annular valve unit in its said lower sealing position.

7. The apparatus of claim 6 wherein said resilient means comprises an expandable member initially positioned on said casing extension beneath said second annular valve unit, said C-expandable member being freed to expand into locking relationship with said second annular valve unit by said fluid pressure produced movement of said second annular valve unit.

8. The apparatus of claim 1 wherein said first annular valve unit defines an internally projecting no-go shoulder and said hollow mandrel has a first external shoulder engaging said no-go shoulder when initially inserted in said seal bore, said hollow mandrel having a second external shoulder initially spaced above the top end of said first annular valve unit, and an internally projecting second no-go shoulder on said conduit extension engaged by said second mandrel external shoulder to limit downward movement of said mandrel relative to said first annular valve unit.

9. The method of cementing a well conduit by cement applied from the surface through a second conduit and a tubular member disposed within the well conduit, comprising the steps of:

(1) providing an axial passage for cement flow through the bottom end of the well conduit;
(2) providing ports for cement flow through the wall of the well conduit at a location spaced above the axial flow passage and a sleeve valve normally closing the ports;
(3) sealingly securing the bottom end of the tubular member with the well conduit;
(4) completing a first stage of cementing by applying cement from the surface through the second conduit, axially through the tubular member and through the axial passage in the bottom of the conduit to fill cement around the well conduit to a level below the cement passage;
(5) sealing the flow path to the axial cement passage;
(6) moving a sleeve valve to open the radial cementing ports;
(7) completing a second stage of cementing by supplying cement from the surface through the second conduit, radially through the tubular member and outwardly through the cementing ports; and
(8) sealing the cementing ports by moving a second sleeve valve on the exterior of the conduit into sealing relationship with the cementing ports.

10. The method of cementing a well conduit by cement applied through a tubular member disposed with the well conduit comprising the steps of:

(1) providing an axial passage for cement flow through the bottom end of the conduit;
(2) providing ports for cement flow through the well of the conduit;
(3) providing a first annular valve within the conduit normally closing the ports and a second annular valve on the outside of the conduit disposed longitudinally from the first annular valve;
(4) sealingly securing the bottom end of the tubular member within the conduit;
(5) completing a first stage of cementing by applying cement axially through the tubular member and through the axial opening in the conduit to fill cement around the conduit to a level below the cement ports;
(6) sealing the flow path to the axial cement passage;
(7) applying pressured fluid through the tubular member to urge the first annular valve longitudinally to open the cement ports;
(8) completing a second stage of cementing by supplying cement radially through the tubular member and outwardly through the cement ports;
(9) moving a sealing plug through the tubular member to effectively seal the bore of the tubular member at a position above the cement ports; and
(10) applying pressured fluid through the tubular member to urge the second annular valve to close the cement ports.

11. A stage cementing apparatus for a well conduit comprising: a tubular conduit extension connectable to the bottom of a well conduit; means in said tubular conduit extension for sealingly mounting the bottom end of a tubular member; a plurality of peripherally spaced radial cement ports in said tubular conduit extension; a first annular valve unit mounted in said conduit extension for movement between a first sealing position relative to said radial cement ports and a second port opening position; first selectively releasable means for securing said first annular valve unit in said first sealing position; means including a first valve element insertable through the tubular member for preventing fluid flow through said conduit extension, thereby permitting pressured fluid applied through the tubular member to exert a force on said first annular valve unit to activate said first selectively releasable means and move said first annular valve unit to its said port opening position, whereby cement may flow from the tubular member through said radial cement ports; a second annular valve unit communicable with said tubular conduit extension for movement between a first nonsealing position relative to said radial cement ports and a second sealing position; means for securing said second valve unit in said first nonsealing position; means including a second valve element insertable through the bore of the tubular member for closing the axial passage of fluid through said tubular conduit extension, thereby permitting pressured fluid supplied through the tubular member to exert a force to said second annular valve unit to move said second annular valve unit to its said port closing position; and means in said tubular conduit extension to maintain continuous pressure equalization integrity and to permit installation and removal of the tubular member to and from sealed position within the conduit extension without hydrostatic pressure locking.

* * * * *